US012584685B2

(12) United States Patent
Naret et al.

(10) Patent No.: US 12,584,685 B2
(45) Date of Patent: Mar. 24, 2026

(54) MAGNETIC ICE CUBE SYSTEM

(71) Applicants: Nicholas Naret, Irwin, PA (US); Joe Aiello, Irwin, PA (US)

(72) Inventors: Nicholas Naret, Irwin, PA (US); Joe Aiello, Irwin, PA (US)

( * ) Notice: Subject to any disclaimer, the term of this patent is extended or adjusted under 35 U.S.C. 154(b) by 171 days.

(21) Appl. No.: 18/392,129

(22) Filed: Dec. 21, 2023

(65) Prior Publication Data

US 2025/0207849 A1 Jun. 26, 2025

(51) Int. Cl.
*F25D 31/00* (2006.01)
*B65D 1/34* (2006.01)
*B65D 25/04* (2006.01)

(52) U.S. Cl.
CPC ..... *F25D 31/003* (2013.01); *B65D 1/34* (2013.01); *B65D 25/04* (2013.01); *B65D 2313/04* (2013.01)

(58) Field of Classification Search
CPC ..... F25D 31/003; F25D 2303/08222; F25D 2303/0842; F25D 3/00; F25D 2331/808; B65D 1/34; B65D 2313/04; A47G 19/2288
USPC ..... 165/67
See application file for complete search history.

(56) References Cited

U.S. PATENT DOCUMENTS 1,847,879 A 3/1932 Knecht
4,761,314 A 8/1988 Marshall
5,148,688 A * 9/1992 Pimm ..... F25D 3/08 126/261
D446,226 S 8/2001 Heredia
6,416,198 B1 7/2002 Vanderschuit
2008/0237084 A1 10/2008 Hopkins
2014/0352349 A1* 12/2014 Prosise ..... A47G 19/2227 220/628
2015/0089964 A1* 4/2015 Chung ..... F25D 3/00 62/62
2016/0288008 A1 10/2016 Wong
2017/0354280 A1* 12/2017 Piscotty ..... A47J 41/00
2018/0220823 A1 8/2018 Lawhon
2020/0375384 A1* 12/2020 Beckman ..... A47G 9/10
2022/0400878 A1* 12/2022 Cooper ..... B65D 81/3869

FOREIGN PATENT DOCUMENTS

WO WO0210642 2/2002

* cited by examiner

*Primary Examiner* — Steve S Tanenbaum

(57) ABSTRACT

A magnetic ice cube system for cooling a beverage with an ice cube while securing the ice cube at the bottom of the beverage glass includes a container having a base wall and a peripheral wall extending upwardly from the base wall to define an interior space. The container holds a liquid within the interior space. A figurine is positionable within the interior space of the container. The figurine cools the liquid when the figurine is a temperature that is lower than a temperature of the liquid and when the figurine is positioned within the interior space. The figurine is magnetic. A container magnet is coupled to the base wall. The container magnet releasably secures the figurine to the base wall of the container.

9 Claims, 8 Drawing Sheets

MAGNETIC ICE CUBE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to beverage cooling assemblies and more particularly pertains to a new beverage cooling assembly for cooling a beverage with an ice cube while securing the ice cube at the bottom of the beverage glass.

(2) Description of Related Art Including Information Disclosed Under 37 CFR 1.97 and 1.98

The prior art relates to beverage cooling assembles. Ice cubes are often used to keep a beverage cool. Traditional ice cubes, made of frozen water or other liquids, melt as the traditional ice cubes cool the beverage. This melting can dilute the beverage, and the traditional ice cubes can only be used once. The prior art therefore discloses reusable ice cubes, often made with stainless steel or plastic materials. The reusable ice cubes do not melt away and dilute the drink. However, these prior art reusable ice cubes may float to the top of the liquid or move upward in the glass as a user is drinking. These prior art reusable ice cubes thus often hit the face or teeth of the user, which can be uncomfortable, annoying, or even result in spilling the beverage. Traditional ice cubes made from frozen water also float at the top of the beverage and can therefore hit the face or teeth of the user as the user is taking a drink of the beverage. Thus, there is a need in the art for an ice cube that can be secured in place at the bottom of the glass.

BRIEF SUMMARY OF THE INVENTION

An embodiment of the disclosure meets the needs presented above by generally comprising a container having a base wall and a peripheral wall extending upwardly from the base wall to define an interior space. The container is configured to hold a liquid within the interior space. A figurine is positionable within the interior space of the container. The figurine is configured to cool the liquid when the figurine is a temperature that is lower than a temperature of the liquid and when the figurine is positioned within the interior space. The figurine is magnetic. A container magnet is coupled to the base wall. The container magnet releasably secures the figurine to the base wall of the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
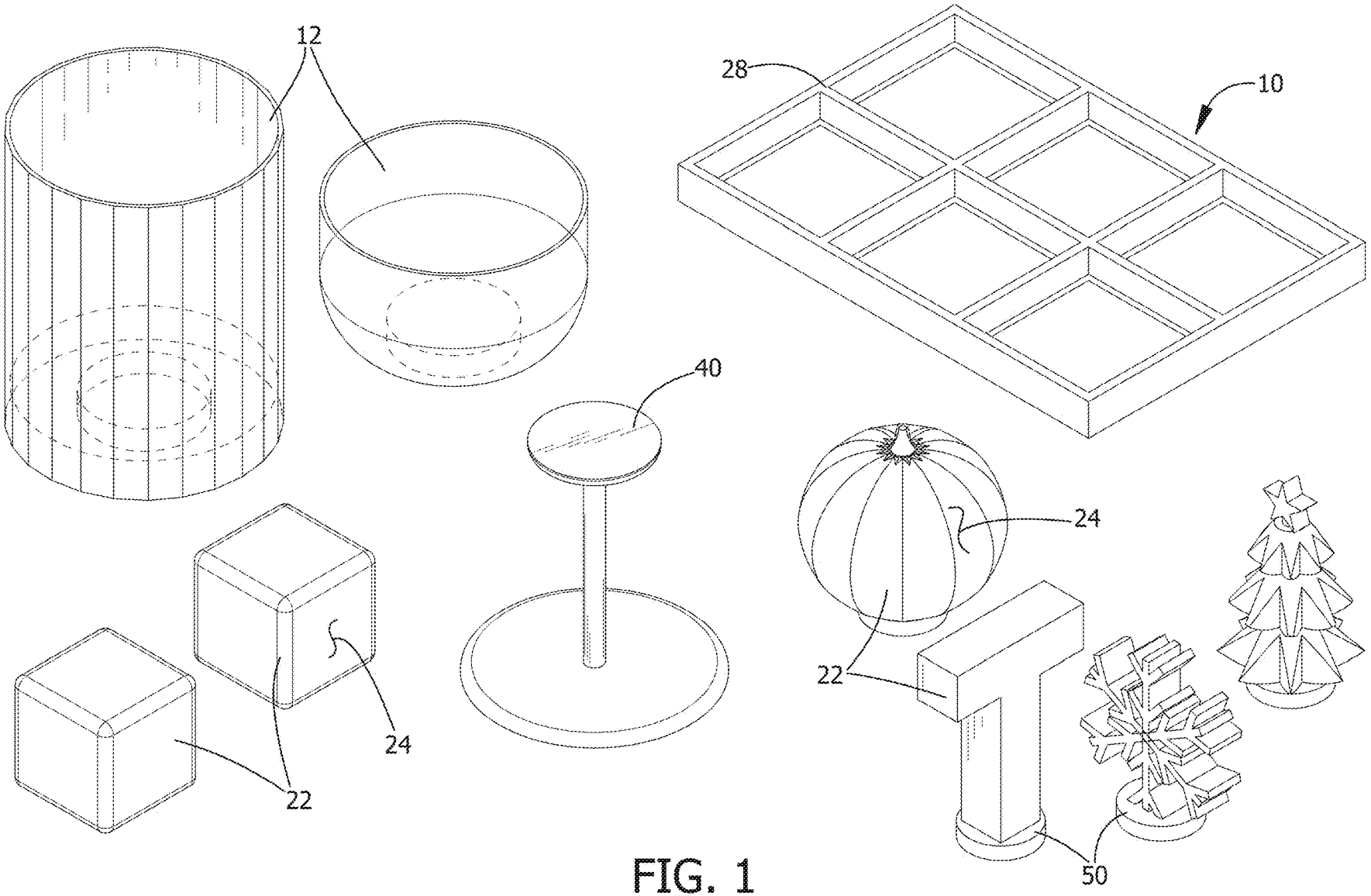
FIG. 1 is an isometric view of a magnetic ice cube system according to an embodiment of the disclosure.
Figure 2:
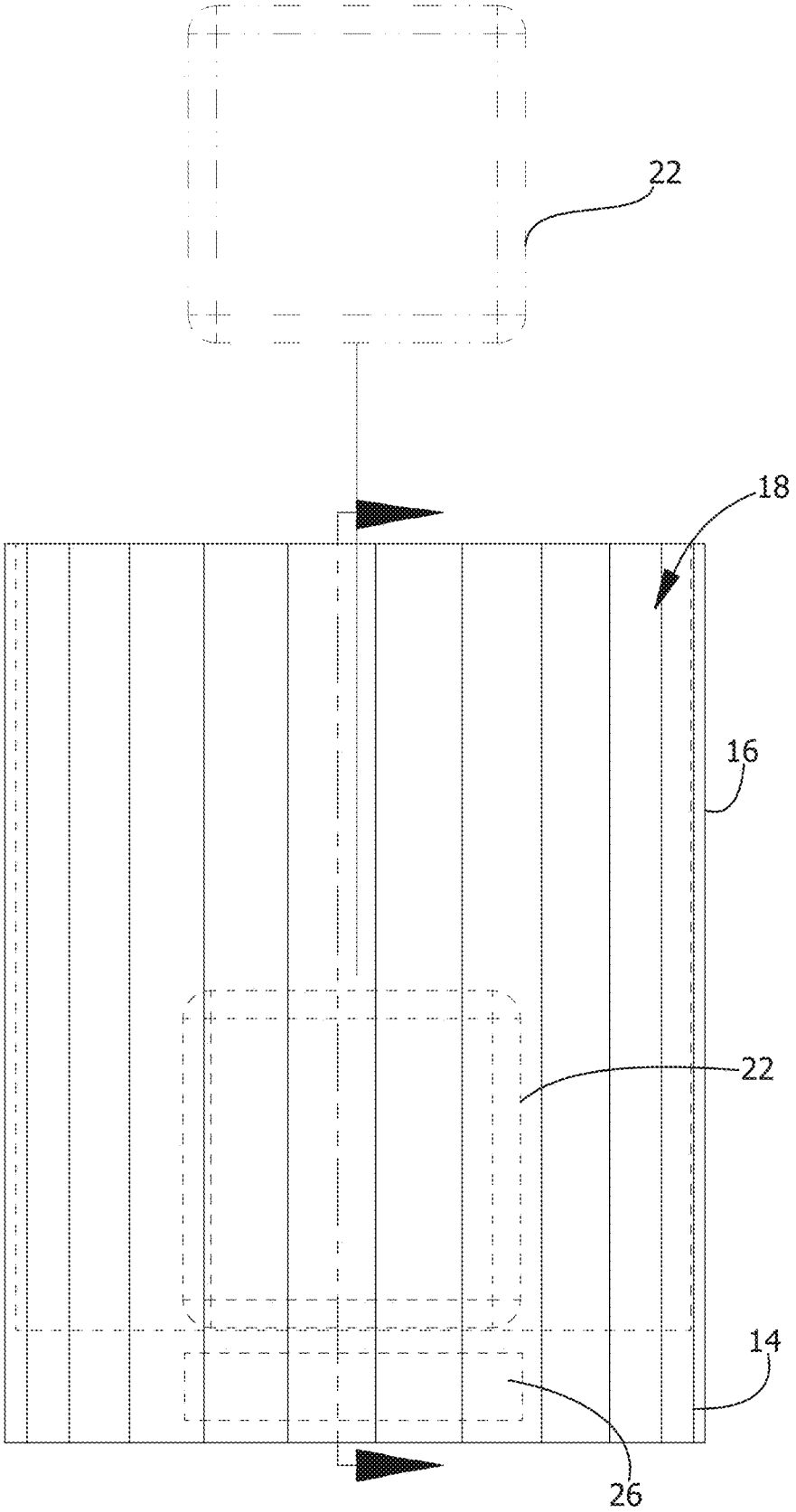
FIG. 2 is a front exploded view of an embodiment of the disclosure.
Figure 3:
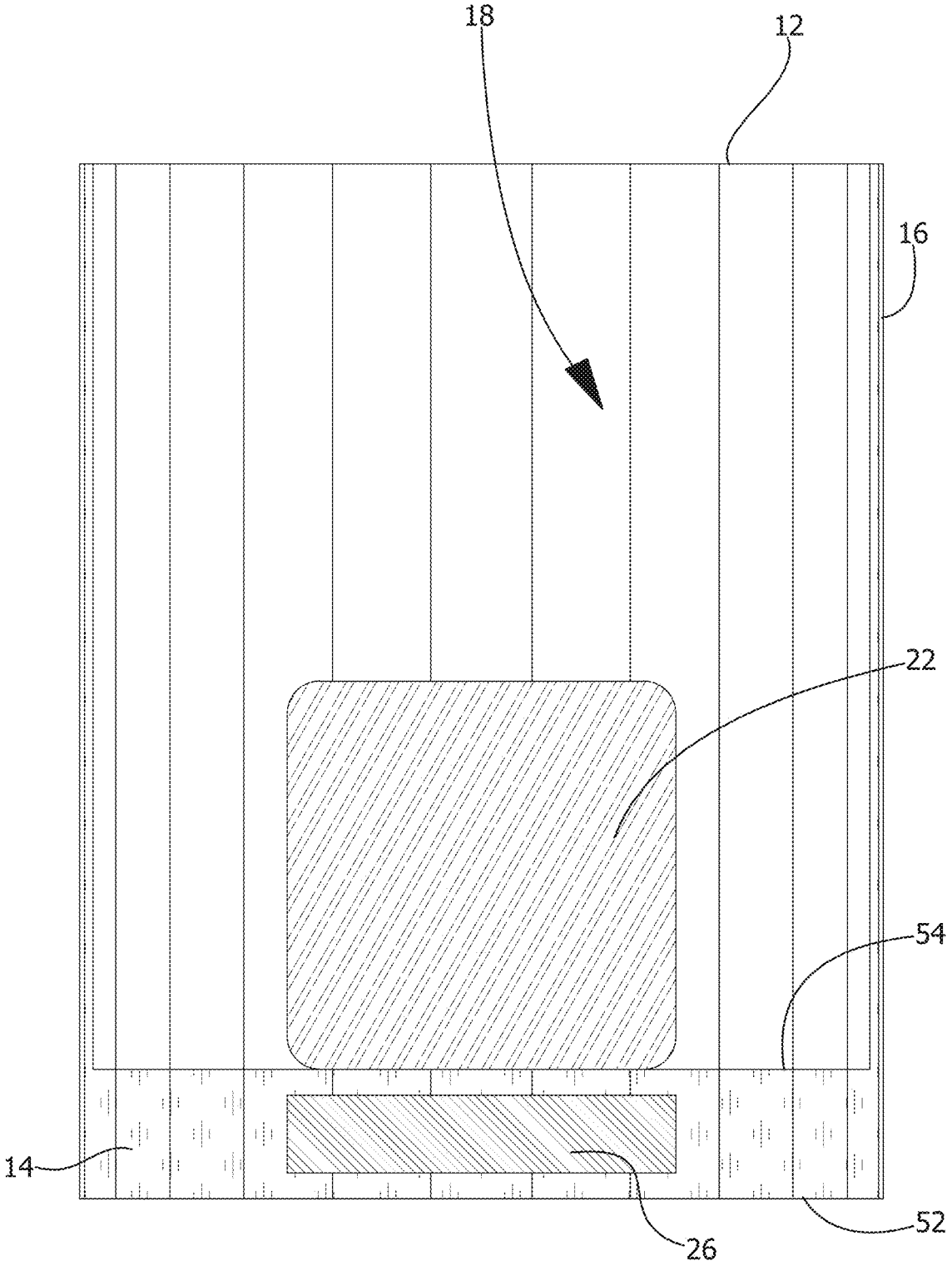
FIG. 3 is a cross-sectional view of an embodiment of the disclosure.
Figure 4:
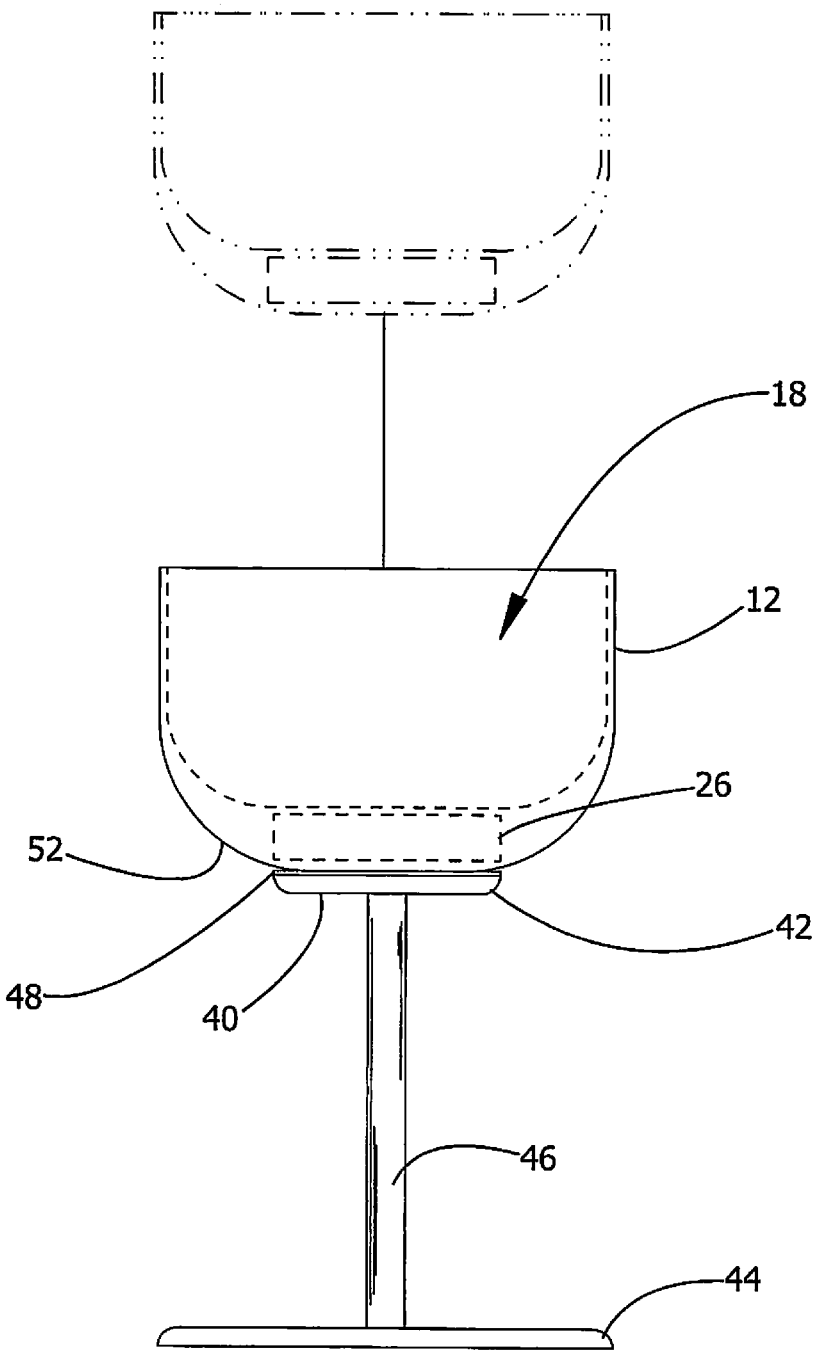
FIG. 4 is an exploded view of an embodiment of the disclosure.
Figure 5:
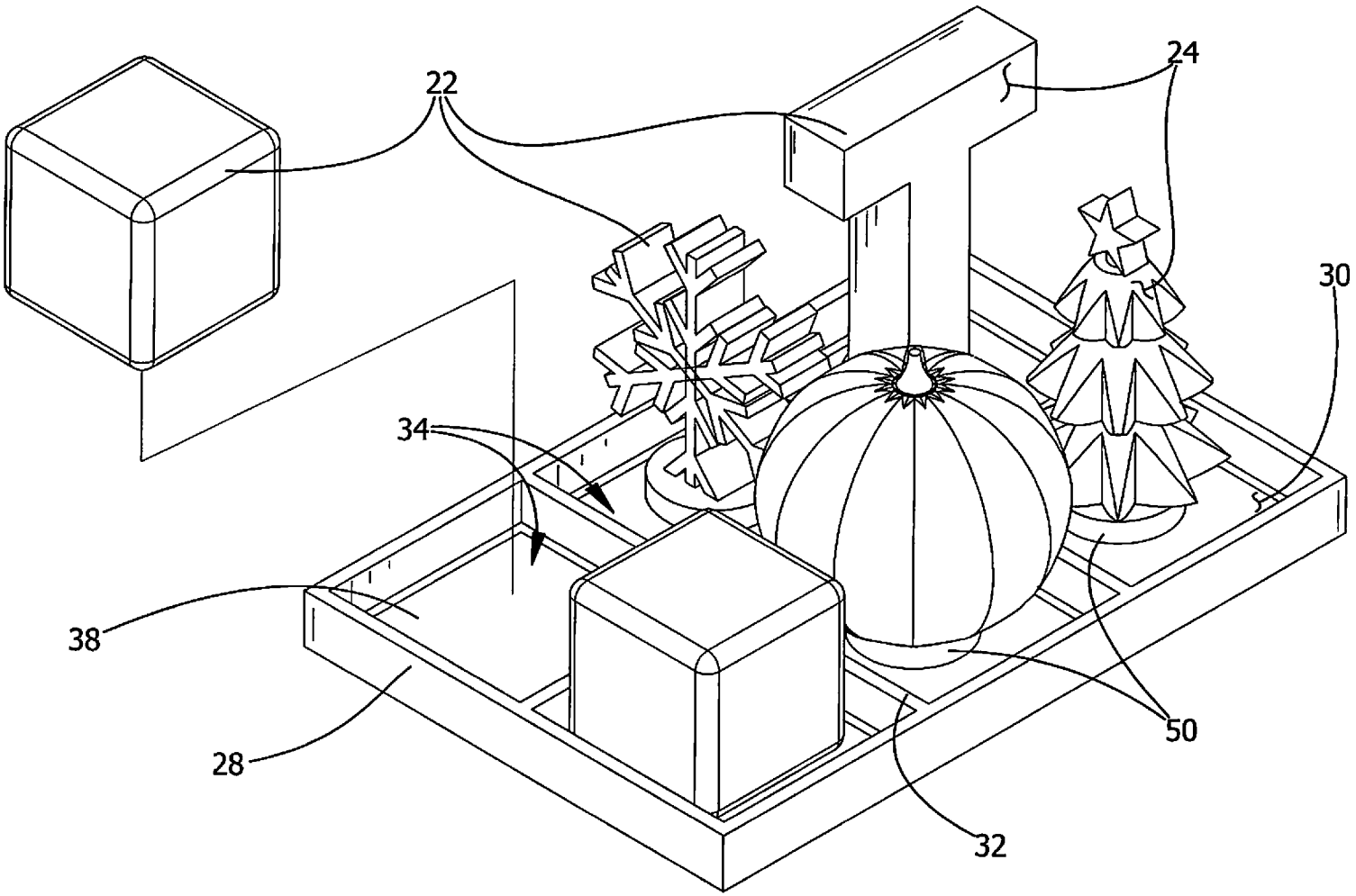
FIG. 5 is an exploded view of an embodiment of the disclosure.
Figure 6:
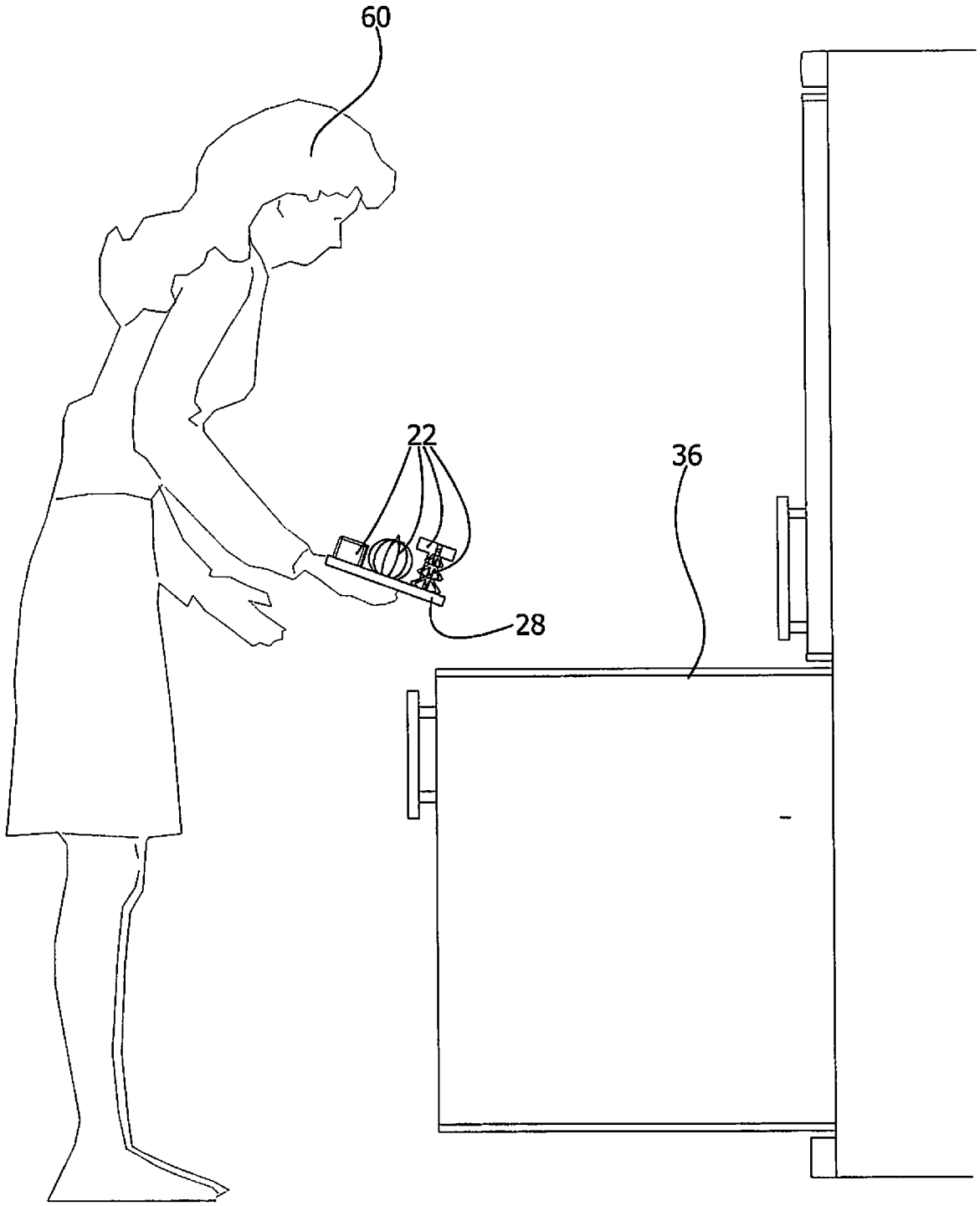
FIG. 6 is a perspective view of an embodiment of the disclosure.
Figure 7:
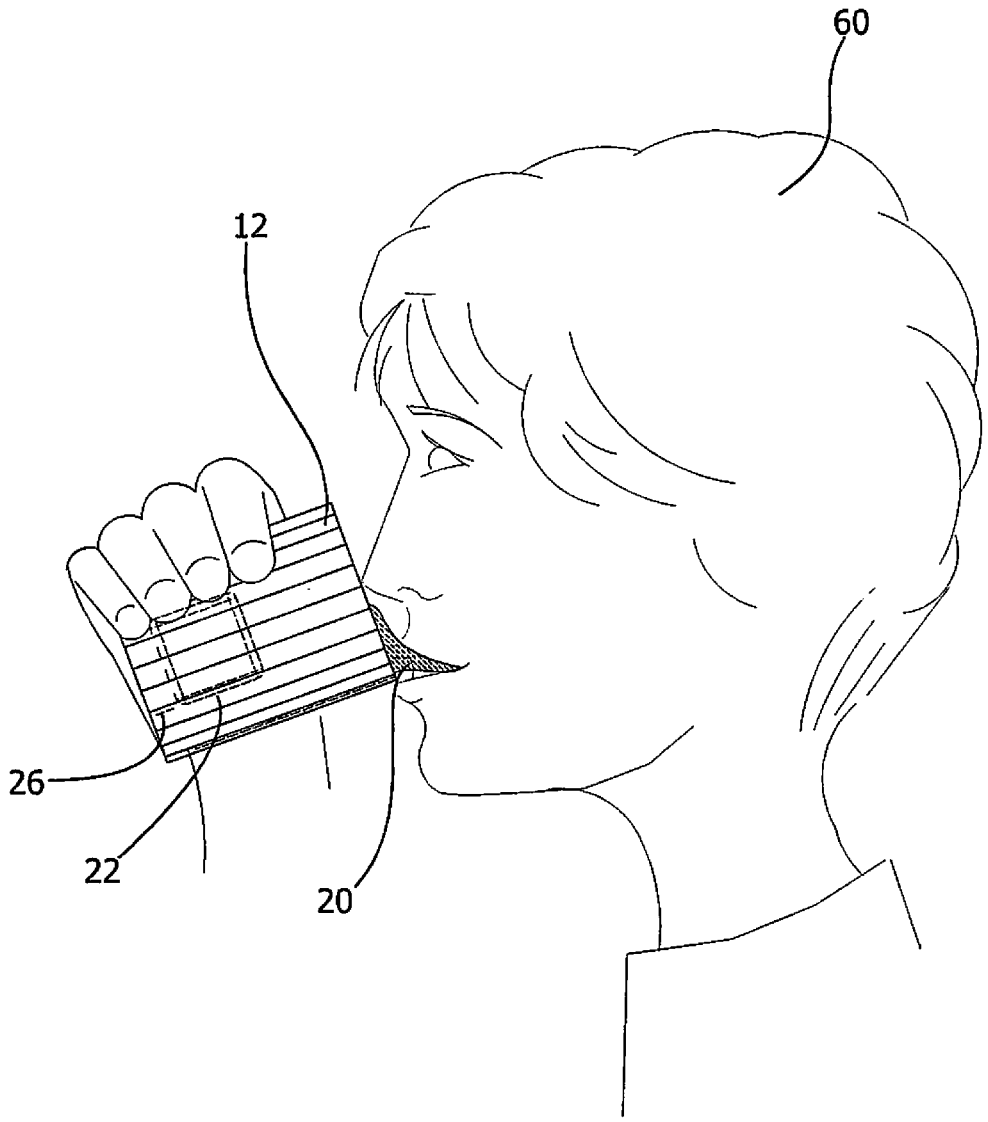
FIG. 7 is an in-use view of an embodiment of the disclosure.

With reference now to the drawings, and in particular to FIGS. 1 through 8 thereof, a new beverage cooling assembly embodying the principles and concepts of an embodiment of the disclosure and generally designated by the reference numeral 10 will be described.

As best illustrated in FIGS. 1 through 8, the magnetic ice cube system 10 generally comprises a plurality of containers 12. Each container of the plurality of containers 12 includes a base wall 14 and a peripheral wall 16 extending upwardly from the base wall 14 to define an interior space 18. Each container of the plurality of containers 12 is configured to hold a liquid 20 within the interior space 18.

The magnetic ice cube system 10 also generally includes a plurality of figurines 22. Each figurine of the plurality of figurines 22 has an exterior surface 24. An associated figurine of the plurality of figurines 22 is positionable within the interior space 18 of a respective container of the plurality of containers 12. The associated figurine of the plurality of figurines 22 is configured to cool the liquid 20 when the associated figurine of the plurality of figurines 22 is a temperature that is lower than a temperature of the liquid 20 and when the associated figurine of the plurality of figurines 22 is positioned within the interior space 18 of the respective container of the plurality of containers 12. Each figurine of the plurality of figurines 22 is magnetic. In alternative embodiments, a figurine magnet 50 may be coupled to the exterior surface 24 of each figurine of the plurality of figurines 22.

Each figurine of the plurality of figurines 22 may comprise a material having a low thermal conductivity, such as stainless steel. Materials with low thermal conductivity are adept at resisting temperature changes and retain energy to help stabilize surrounding temperatures. Such materials may be appropriate because the materials may facilitate the plurality of figurines 22 in cooling the liquid 20 surrounding the associated figurine of the plurality of figurines 22 within the interior space 20 of the respective container of the plurality of containers 12.

A container magnet 26 is coupled to, or embedded within, the base wall 14 of each container of the plurality of containers 12. The container magnet 26 releasably secures the associated figurine of the plurality of figurines 22 to the base wall 14 of the respective container of the plurality of containers 12. The container magnet 26 is magnetically attracted to each figurine of the plurality of figurines 22 when each figurine of the plurality of figurines 22 is magnetic. In embodiments having the figurine magnet 50 coupled to the exterior surface 24 of each figurine of the plurality of figurines 22, the container magnet 26 is magnetically attracted to the figurine magnet 50.

Each figurine of the plurality of figurines 12 may have a distinctive shape. Exemplary shapes of the plurality of figurines 12 are provided in FIG. 1. The distinctive shape of the plurality of figurines 12 facilitates visual distinction of the respective container of the plurality of containers 12 when the associated figurine of the plurality of figurines 22 is positioned in the interior space 18 of the respective container of the plurality of containers 12.

Embodiments of the magnetic ice cube system 10 may also include a tray 28 having an upper side 30. A plurality of raised edges 32 may extend upwardly from the upper side 30. The plurality of raised edges 32 generally define a plurality of sections 34 within the tray 28. Each figurine of the plurality of figurines 22 is positionable on the upper side 30 within a respective one of the plurality of sections 34. The tray 28 is configured to facilitate placement of the plurality of figurines 22 within a freezer 36 to lower the temperature of the plurality of figurines 22.

A tray magnet 38 may be coupled to the upper side 30 of the tray 28 within each of the plurality of sections 34. In other words, the magnetic ice cube system 10 may include a plurality of tray magnets 38, wherein each tray magnet of the plurality of tray magnets 38 is coupled to the upper side 30 of the tray 28 and is positioned within a respective section of the plurality of sections 34. The tray magnet 38 releasably secures the plurality of figurines 22 to the upper side 30 of the tray 28. More specifically, the tray magnet 38 within each section of the plurality of sections 34 is magnetically attracted to each figurine of the plurality of figurines 22, or to the figurine magnet 50 coupled to each figurine of the plurality of figurines 22. The magnetic attraction releasably retains each figurine of the plurality of figurines 22 to the respective section of the plurality of sections 34 on the tray 28. The tray magnet 38 may be embedded within or coupled to the tray 28. Alternatively, the entire upper side 30 of the tray 28 may be magnetic, with a polarity that is complementary to a polarity of the plurality of figurines 22 or the figurine magnet 50.

Some embodiments of the tray 28, such as the embodiment shown in FIG. 1, may have six sections of the plurality of sections 34. The six sections may be arranged in two adjacent rows with three sections per row. Other embodiments, such as the embodiment shown in FIG. 8, may have eight sections of the plurality of sections 34. The eight sections may be arranged in two adjacent rows with four sections per row. Alternative embodiments may have other numbers or arrangements of sections within the tray 28.

Figure 8:
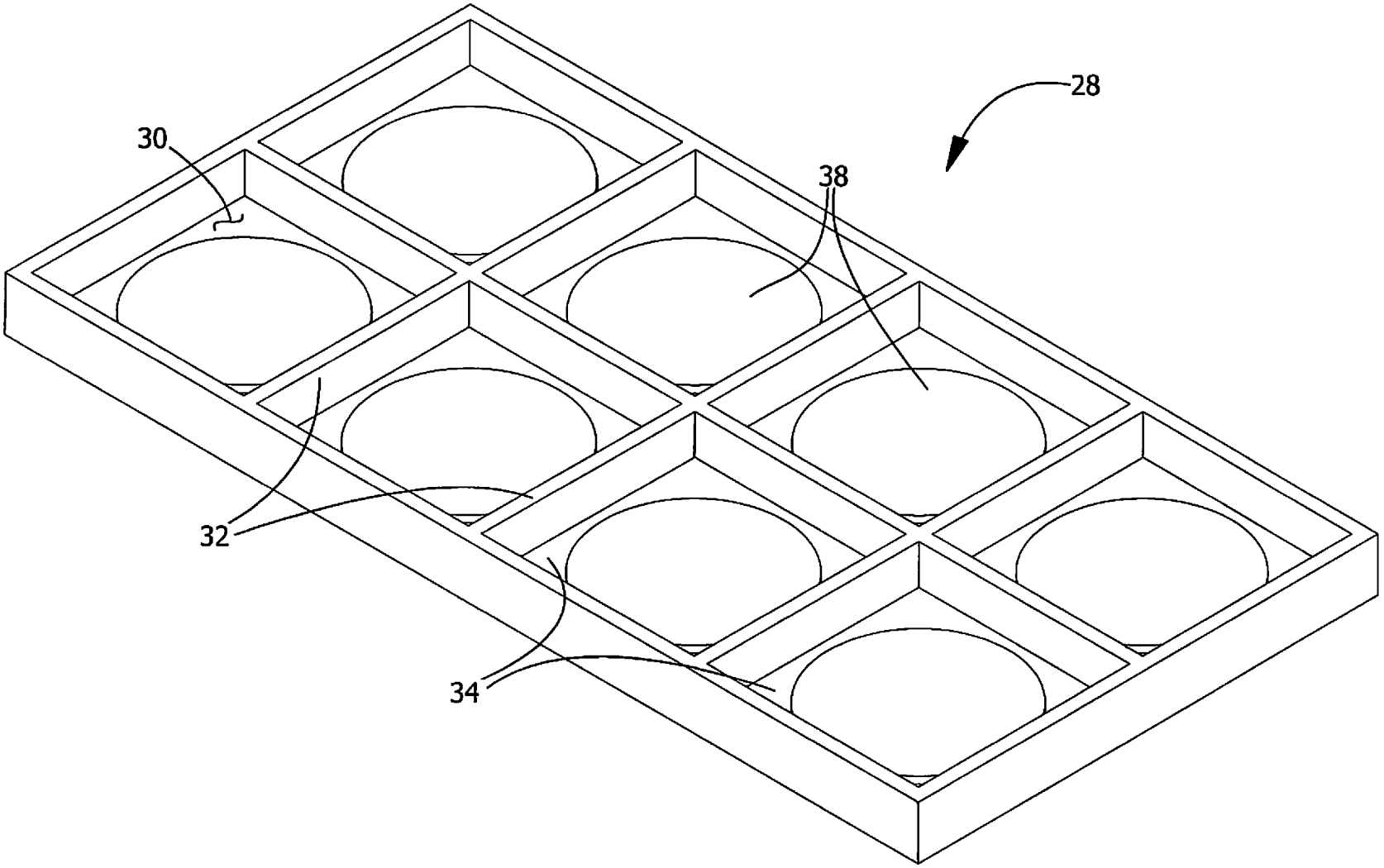
FIG. 8 is an isometric view of an embodiment of the disclosure.

The tray magnet 38 may have a circular shape, as shown in FIG. 8. The tray magnet 38 may alternatively having a square shape, as shown in FIG. 1. Alternative shapes of the tray magnet 38 may also be included.

The magnetic ice cube system 10 may further include a stem 40 having a first panel 42, a second panel 44, and a column 46 that is coupled to and extends between the first panel 42 and the second panel 44. The first panel 42 is releasably couplable with the base wall 14 of the plurality of containers 12. For example, when the stem 40 is coupled to the respective container of the plurality of containers 12, the stem 40 is configured to support the respective container of the plurality of containers 12 above a surface. The second panel 44 may have a diameter exceeding a diameter of the first panel 42. The first panel 42 may have a diameter exceeding a diameter of the column 46.

A stem magnet 48 may be coupled to the first panel 42 of the stem 40. The stem magnet 48 secures the stem 40 to an outer surface 52 of the base wall 14 of an associated container of the plurality of containers 12. For example, the stem magnet 48 may have a polarity that is complementary to a polarity of the container magnet 26. The stem magnet is thus magnetically attracted to and releasably retained by the container magnet 26.

The magnetic ice cube system 10 may include a plurality of stems 40, with each stem of the plurality of stems 40 having the first panel 42, the second panel 44, and the column 46 as described above. Such embodiments would also include a plurality of stem magnets 48, with each stem magnet of the plurality of stem magnets 48 being coupled to the first panel 42 of a respective stem of the plurality of stems 40.

In use, each figurine of the plurality of figurines 22 can be magnetically retained to the inner surface 54 of the base wall 14 of each container of the plurality of containers 12. When a user 60 tips the respective container of the plurality of containers 12, the associated figurine of the plurality of figurines 22 within the respective container will remain secured to the base wall 14. The distinct shapes of the plurality of figurines 22 can help to distinguish the various containers of the plurality of containers 12. For example, a square figurine will be visually distinct from a pumpkin-shaped figurine on the base wall 14 of the respective containers in which the square figurine and pumpkin figurine are placed. This visual distinction can facilitate various users 60 in differentiating their own beverages from the beverages of other users.

The stem 40 provides increased utility to the plurality of containers 12. For example, one user 60 may want to use the magnetic ice cube system for a glass of wine and may therefore want to couple the stem 40 to the outer surface 52 of the base wall 14 to transform their container into a wine glass. A second user may want to use the magnetic ice cube system for a glass of juice and may therefore want to use their container without the stem.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A reusable ice cube system comprising:

a container having a base wall and a peripheral wall extending upwardly from the base wall to define an interior space, the container being configured to hold a liquid within the interior space;

a figurine being positionable within the interior space of the container, the figurine being configured to cool the liquid when the figurine is a temperature that is lower than a temperature of the liquid and when the figurine is positioned within the interior space, the figurine being magnetic;

a container magnet being coupled to the base wall, the container magnet releasably securing the figurine to the base wall of the container;

the container being one container of a plurality of containers;

the figurine being one figurine of a plurality of figurines;

a tray having an upper side;

a plurality of raised edges extending upwardly from the upper side, the plurality of raised edges defining a plurality of sections within the tray, each figurine of the plurality of figurines being positionable on the upper side within a respective one of the plurality of sections wherein the tray is configured to facilitate placement of the plurality of figurines within a freezer to lower the temperature of the plurality of figurines; and a tray magnet being coupled to the upper side of the tray within each of the plurality of sections, the tray magnet releasably securing the plurality of figurines to the upper side of the tray.

2. The reusable ice cube system of claim 1, wherein each figurine of the plurality of figurines has a distinctive shape relative to each other figurine wherein an associated figurine of the plurality of figurines facilitates visual distinction of a respective container of the plurality of containers when the associated figurine is positioned in the interior space of the respective container of the plurality of containers.

3. The reusable ice cube system of claim 1, further comprising a plurality of stems, each stem of the plurality of stems having a first panel, a second panel, and a column being coupled to and extending between the first panel and the second panel, the first panel of a respective stem of the plurality of stems being releasably couplable with the base wall of an associated container of the plurality of containers, the respective stem of the plurality of stems being configured to support the associated container of the plurality of containers above a surface when the first panel of the respective stem is coupled to the base wall of the associated container.

4. The reusable ice cube system of claim 1, wherein the container magnet is embedded in the base wall.

5. A reusable ice cube system comprising:

a container having a base wall and a peripheral wall extending upwardly from the base wall to define an interior space, the container being configured to hold a liquid within the interior space;

a figurine being positionable within the interior space of the container, the figurine being configured to cool the liquid when the figurine is a temperature that is lower than a temperature of the liquid and when the figurine is positioned within the interior space, the figurine being magnetic;

a container magnet being coupled to the base wall, the container magnet releasably securing the figurine to the base wall of the container; and a stem having a first panel, a second panel, and a column being coupled to and extending between the first panel and the second panel, the first panel being releasably couplable with the base wall of the container, the stem being configured to support the container above a surface when the first panel is coupled to the base wall.

6. The reusable ice cube system of claim 5, wherein the second panel has a diameter exceeding a diameter of the first panel.

7. The reusable ice cube system of claim 5, wherein each of the first panel and the second panel has a diameter exceeding a diameter of the column.

8. The reusable ice cube system of claim 5, further comprising a stem magnet being coupled to the first panel of the stem, the stem magnet securing the stem to an outer surface of the base wall of an associated one of the plurality of containers.

9. A reusable ice cube system comprising:

a plurality of containers, each container of the plurality of containers having a base wall and a peripheral wall extending upwardly from the base wall to define an interior space, each container of the plurality of containers being configured to hold a liquid within the interior space;

a plurality of figurines, each figurine of the plurality of figurines having an exterior surface, an associated figurine of the plurality of figurines being positionable within the interior space of a respective container of the plurality of containers, the associated figurine being configured to cool the liquid when the associated figurine is a temperature that is lower than a temperature of the liquid and when the associated figurine is positioned within the interior space of the respective container, the exterior surface of each figurine of the plurality of figurines being magnetic;

a container magnet being embedded within the base wall of each container of the plurality of containers, the container magnet releasably securing the associated figurine to the base wall of the respective container;

each figurine of the plurality of figurines having a distinctive shape relative to each other figurine wherein the associated figurine facilitates visual distinction of the respective container of the plurality of containers when the associated figurine is positioned in the interior space of the respective container of the plurality of containers;

a tray having an upper side;

a plurality of raised edges extending upwardly from the upper side, the plurality of raised edges defining a plurality of sections within the tray, each figurine of the plurality of figurines being positionable on the upper side within a respective one of the plurality of sections wherein the tray is configured to facilitate placement of the plurality of figurines within a freezer to lower the temperature of the plurality of figurines;

a tray magnet being coupled to the upper side of the tray within each of the plurality of sections, the tray magnet releasably securing the plurality of figurines to the upper side of the tray;

a stem having a first panel, a second panel, and a column being coupled to and extending between the first panel and the second panel, the first panel being releasably couplable with the base wall of the respective container of the plurality of containers, the stem being configured to support the respective container above a surface when the first panel is coupled to the base wall, the second panel having a diameter exceeding a diameter of the first panel, the first panel having a diameter exceeding a diameter of the column; and a stem magnet being coupled to the first panel of the stem, the stem magnet securing the stem to an outer surface of the base wall of an associated one of the plurality of containers.

* * * * *